US007619378B2

(12) United States Patent
Morinaga et al.

(10) Patent No.: US 7,619,378 B2
(45) Date of Patent: Nov. 17, 2009

(54) ROTATION CONTROL DEVICE, ROTATION CONTROL METHOD AND CONSTRUCTION MACHINE

(75) Inventors: Jun Morinaga, Hiratsuka (JP); Hiroaki Inoue, Hiratsuka (JP)

(73) Assignee: Komatsu Ltd., Tokyo (JP)

( * ) Notice: Subject to any disclaimer, the term of this patent is extended or adjusted under 35 U.S.C. 154(b) by 295 days.

(21) Appl. No.: 11/631,433

(22) PCT Filed: Jul. 4, 2005

(86) PCT No.: PCT/JP2005/012303

§ 371 (c)(1),
(2), (4) Date: Jan. 3, 2007

(87) PCT Pub. No.: WO2006/004080

PCT Pub. Date: Jan. 12, 2006

(65) Prior Publication Data

US 2008/0018271 A1 Jan. 24, 2008

(30) Foreign Application Priority Data

Jul. 5, 2004 (JP) ..... 2004-198198

(51) Int. Cl.
*E02F 9/20* (2006.01)

(52) U.S. Cl. ..... 318/139; 318/268

(58) Field of Classification Search ..... 318/139, 318/268; 123/361
See application file for complete search history.

(56) References Cited

U.S. PATENT DOCUMENTS 3,643,635 A * 2/1972 Milam ..... 123/676
3,865,209 A * 2/1975 Aihara et al. ..... 180/65.1
4,248,194 A * 2/1981 Drutchas et al. ..... 123/357
4,353,339 A * 10/1982 Collonia ..... 123/350

(Continued)

FOREIGN PATENT DOCUMENTS

JP 2001-11897 A 1/2001

(Continued)

OTHER PUBLICATIONS

Notification Concerning Transmittal of Copy of International Preliminary Report on Patentability and Written Opinion, Chapter I of the Patent Cooperation Treaty dated Jan. 16, 2007, for PCT/JP2005/012303, 4 sheets.

*Primary Examiner*—Bentsu Ro
(74) *Attorney, Agent, or Firm*—Frishauf, Holtz, Goodman & Chick, P.C.

(57) ABSTRACT

A control device 50 of an electric rotary excavator generates a rotation speed coefficient in accordance with a setting condition of a fuel dial 13 and a selection condition of a mode selection switch 14 and changes a value of a target speed command value based on the rotation speed coefficient to change a rotation speed of a rotary body 4. Accordingly, when the engine speed becomes low through operation of the fuel dial 13 or the mode selection switch 14, the rotation speed of the rotary body 4 can be decreased accordingly, while when the engine speed becomes high, the rotation speed can be increased accordingly. Therefore, the operation feeling substantially similar to a conventional arrangement for hydraulically rotating the rotary body 4 can be obtained, so that the operator is not confused when the operator shifts excavators from the conventional hydraulic excavator to the electric rotary excavator.

3 Claims, 13 Drawing Sheets

U.S. PATENT DOCUMENTS

| | | | | | |
|---|---|---|---|---|---|
| 4,359,984 | A | * | 11/1982 | Nakao | 123/357 |
| 4,577,604 | A | * | 3/1986 | Hara et al. | 123/397 |
| 4,940,034 | A | * | 7/1990 | Heim et al. | 123/497 |
| 6,820,356 | B2 | * | 11/2004 | Naruse et al. | 37/348 |
| 2005/0001606 | A1 | * | 1/2005 | Kagoshima | 323/371 |
| 2005/0237021 | A1 | * | 10/2005 | Sugano et al. | 318/610 |

FOREIGN PATENT DOCUMENTS

| | | | |
|---|---|---|---|
| JP | 2001-12274 | A | 1/2001 |
| JP | 2001-207478 | A | 8/2001 |
| JP | 2001-226077 | A | 8/2001 |
| JP | 2003-33063 | A | 1/2003 |

* cited by examiner

ROTATION CONTROL DEVICE, ROTATION CONTROL METHOD AND CONSTRUCTION MACHINE

This application is a U.S. National Phase Application under 35 USC 371 of International Application PCT/JP2005/012303 filed Jul. 4, 2005.

TECHNICAL FIELD

The present invention relates to a rotation control device and a rotation control method for controlling a rotary body that is rotated by an electric motor and a construction machine.

BACKGROUND ART

Recently, hybrid electric rotary excavators have been being developed, in which a rotary body is driven by an electric motor while a work machine and a carrier are driven by a hydraulic actuator (see, for instance, Patent Document 1).

Since the rotation of the rotary body is driven by the electric motor in such electric rotary excavators, even when the rotary body is rotated while a boom and an arm that are driven hydraulically are lifted up, the rotation of the rotary body is not affected by the lifting of the boom and the arm. Accordingly, an energy loss at control valves or the like can be reduced as compared to typical hydraulic excavators in which the rotary body is also driven hydraulically, thereby enhancing energy efficiency.

Meanwhile, in typical hydraulic excavators, the rotary body is also driven by hydraulic pressure from a hydraulic pump like the work machine, the hydraulic pump being driven by an engine. Due to the arrangement, by changing an amount of fuel supply to the engine to adjust engine speed, discharge rate of hydraulic oil from the hydraulic pump changes accordingly, thereby changing rotation speed of the rotary body. Specifically, by turning a fuel dial to reduce the amount of fuel supply, the engine speed decreases, thereby decreasing the rotation speed of the rotary body accordingly. In contrast, by turning the fuel dial to increase the amount of fuel supply, the engine speed increases, thereby increasing the rotation speed of the rotary body accordingly.

In such hydraulic excavators, change of the amount of fuel supply to deliberately adjust the engine speed is performed also by operating a mode selection switch for selecting a work mode in addition to operating the fuel dial. The work mode includes an active mode, an economy mode, a breaker mode, a lift mode and the like in descending order of the engine speed, the work mode selected properly depending on a work to be performed.

[Patent Document 1] JP-A-2001-11897

DISCLOSURE OF THE INVENTION

Problems to be Solved by the Invention

However, in the electric rotary excavator disclosed in Patent Document 1, the rotary body is not driven hydraulically, and the rotary body rotates in a constant rotation speed independently of the engine speed. Hence, an operator who has shifted excavators from the hydraulic excavator to the electric rotary excavator may be confused by the motion of the rotary body that does not change in accordance with the engine speed.

In addition, in the hydraulic excavator, the change of the rotation speed also occurs when work machines such as the boom and the arm are driven during the rotation of the rotary body. This is because the hydraulic oil used for rotating the rotary body is also used for driving the work machines, thereby decreasing the rotation speed. Even in such a situation, the rotation speed is also constant in the electric rotary excavator, which also confuses the operator.

An object of the present invention is to provide a rotation control device, a rotation control method and a construction machine that do not confuse an operator even when drive of a rotary body is switched from hydraulic drive to electric drive.

Means for Solving the Problems

According to an aspect of the present invention, a rotation control device for controlling a rotary body that is rotated by an electric motor includes a target speed command generating means that is adapted to change a target speed command value of the rotary body in accordance with at least one of the following factors: a setting condition of a fuel supply setting means for setting a fuel supply to an engine that is used in conjunction with the electric motor; an operation amount of a work machine lever for operating a work machine that is driven by the engine; and a selection condition of a work mode selecting means for selecting a work mode of a work performed using the work machine to set the fuel supply to the engine.

According to another aspect of the present invention, a rotation control method for controlling a rotary body that is rotated by an electric motor includes changing a rotation speed of the rotary body in accordance with at least one of the following factors: a setting condition of a fuel supply setting means for setting a fuel supply to an engine that is used in conjunction with the electric motor; an operation amount of a work machine lever for operating a work machine that is driven by the engine; and a selection condition of a work mode selecting means for selecting a work mode of a work performed using the work machine to set the fuel supply to the engine.

According to still another aspect of the present invention, a construction machine includes: a rotary body that is rotated by an electric motor; and the above-described rotation control device of the present invention, the rotation control device controlling the rotary body.

EFFECT OF THE INVENTION

According to the aspect of the present invention, a target speed command signal for the electric motor is generated in accordance with the setting condition of the fuel supply setting means (e.g., a fuel dial), the selection condition of the work mode selecting means (e.g., a mode selection switch) and the operation amount of the work machine lever, and the rotation speed of the rotary body is changed based on the target speed command signal. With the arrangement, when engine speed is low due to the conditions of these means, the rotation speed of the rotary body is decreased accordingly, while when the engine speed is high, the rotation speed is increased accordingly. In addition, even when the work machine is operated during rotation of the rotary body, the rotation speed can be decreased. Therefore, operability substantially similar to a general arrangement in which the rotary body is hydraulically rotated can be obtained, which does not confuse an operator.

EXPLANATION OF CODES

Figure 1:
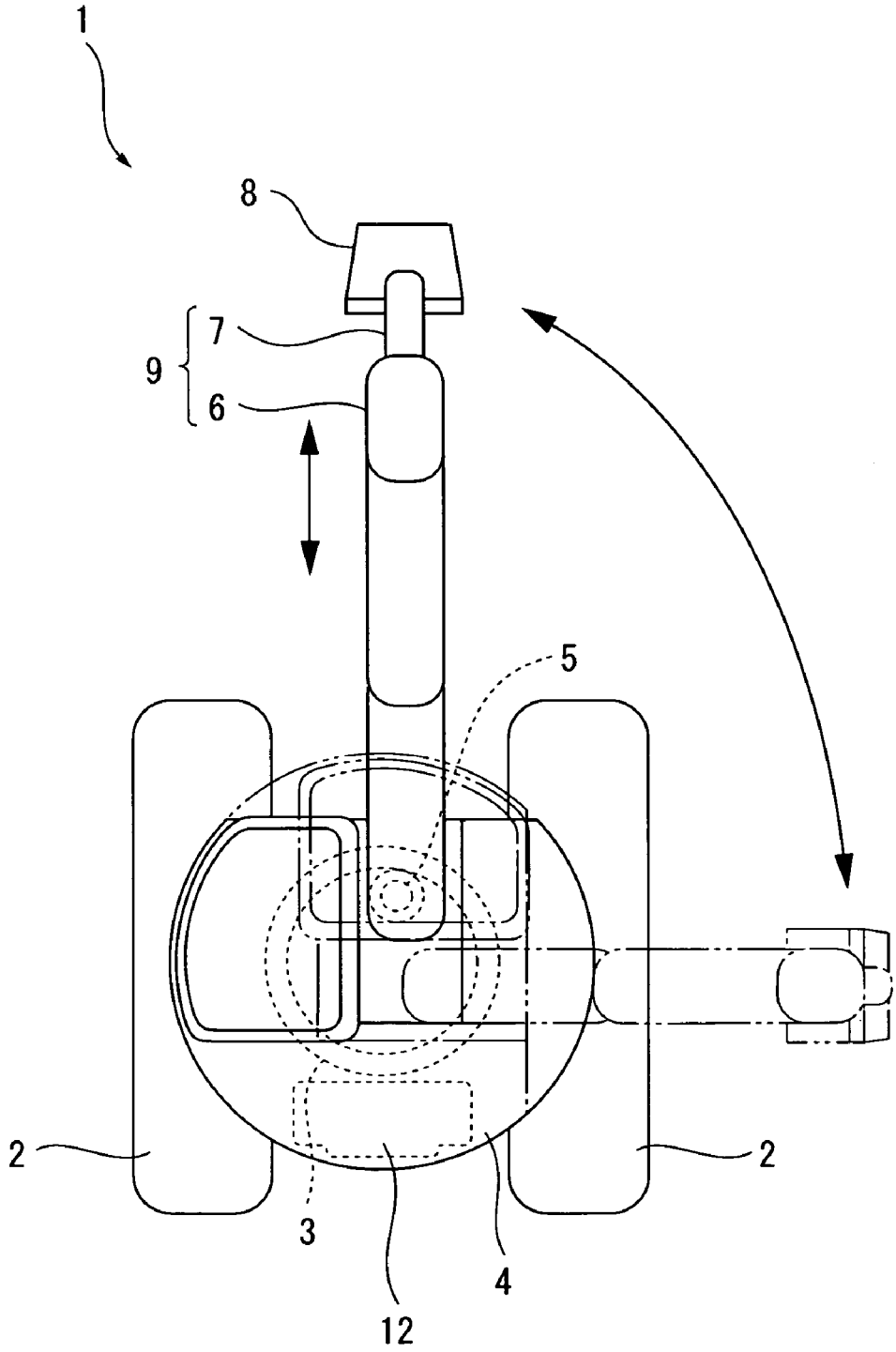
FIG. 1 is a plan view showing a construction machine according to a first embodiment of the present invention.

1: electric rotary excavator (construction machine)
4: rotary body
5: electric motor
9: work machine
12: engine
13: fuel dial (fuel supply setting means)
14: mode selection switch (work mode selecting means)
16: work machine lever
50: control device (rotation control device)
56: target speed command generating means

BEST MODE FOR CARRYING OUT THE INVENTION

First Embodiment

[1-1] Overall Arrangement

A first embodiment of the present invention will be described below with reference to the attached drawings.

Figure 2:
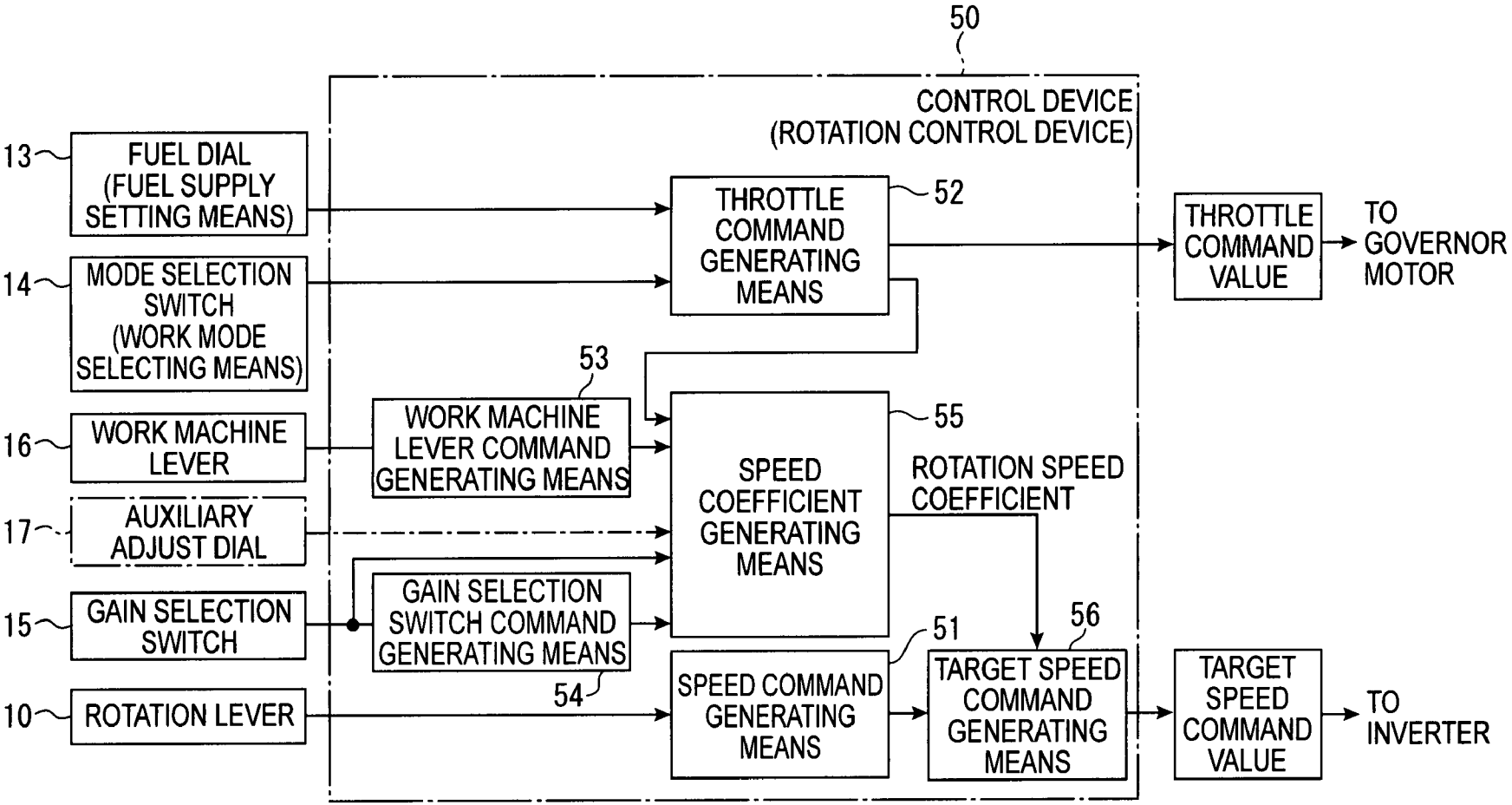
FIG. 2 is a block diagram for explaining a rotation control device mounted in the construction machine according to the first embodiment.

FIG. 1 is a plan view showing an electric rotary excavator 1 (construction machine) according to the first embodiment. FIG. 2 is a block diagram for explaining a control device 50 (rotation control device) mounted in the electric rotary excavator 1.

In FIG. 1, the electric rotary excavator 1 includes a rotary body 4 that is mounted on a track frame of a base carrier 2 via a swing circle 3, the rotary body 4 being rotated by an electric motor 5 that is engaged with the swing circle 3. Although not shown, a power source of the electric motor 5 is a generator mounted in the rotary body 4, the generator being driven by an engine 12.

The rotary body 4 is provided with a boom 6, an arm 7 and a bucket 8 that are each operated by a hydraulic cylinder (not shown), these members 6 to 8 forming a work machine 9. A hydraulic source of each hydraulic cylinder is a hydraulic pump driven by the engine 12. Thus, the electric rotary excavator 1 is a hybrid construction machine having the hydraulically-driven work machine 9 and the electrically-driven rotary body 4.

As shown in FIG. 2, in the electric rotary excavator 1, a rotation lever 10 (typically, also serving as a work machine lever for operating the arm 7) outputs a lever signal according to its tilting angle to the control device 50. Specifically, the lever signal is first input to a speed command generating means 51 of the control device 50, where the lever signal is converted to a reference target speed. The reference target speed is multiplied by a rotation speed coefficient that is obtained based on input settings of a fuel dial 13 (fuel supply setting means), a mode selection switch 14 (work mode selecting means), a gain selection switch 15, a work machine lever 16 and the like. Through the multiplication, the reference target speed is converted to a target speed command value of the rotary body 4 and output to an inverter (not sown).

The rotation speed coefficient is used for adjusting the target speed command value. For example, when the rotation speed coefficient is set to a value greater than "1", the target speed command value that is obtained through multiplication of this value by the reference target speed will be large, so that the rotation speed of the electric motor 5 will be increased. In contrast, when the rotation speed coefficient is set to a value smaller than "1" (but greater than "0"), the target speed command value will be small, so that the rotation speed of the electric motor 5 will be decreased.

The inverter compares a fed-back actual speed of the electric motor 5 with the target speed command value to set a motor torque command value according to a deviation therebetween. Then, the inverter converts the torque command value to a current value and a voltage value, and controls the electric motor 5 to drive at the target speed. Accordingly, in a case where the actual speed is not increased even when the rotation lever 10 is tilted, to a large extent the inverter performs a control to increase a torque output so that the actual speed is increased to be close to the target speed. Note that such control is a speed control performed by a typical P (Proportional) control.

[1-2] Relation between Arrangement of Control Device and Input Settings

Now, relations between the arrangement of the control device 50 and input settings will be described referring to FIGS. 2 to 11.

In FIG. 2, the control device 50 generates the target speed command value of the rotary body 4 based on input settings from the rotation lever 10, the fuel dial 13, the mode selection switch 14, the gain selection switch 15, the work machine lever 16 and the like. For this purpose, the control device 50 includes the speed command generating means 51, a throttle command generating means 52, a work machine lever command generating means 53, a gain selection switch command generating means 54, a speed coefficient generating means 55 and a target speed command generating means 56. The control device 50 also controls an amount of fuel supply (injection) to the engine 12.

First, the speed command generating means 51 generates the reference target speed of the rotary body 4 based on the tilt angle of the rotation lever 10. The reference target speed generated herein is a value on which the target speed command value is based. When the rotation speed coefficient is "1", the reference target speed is output to the inverter as the target speed command value.

Figure 3:
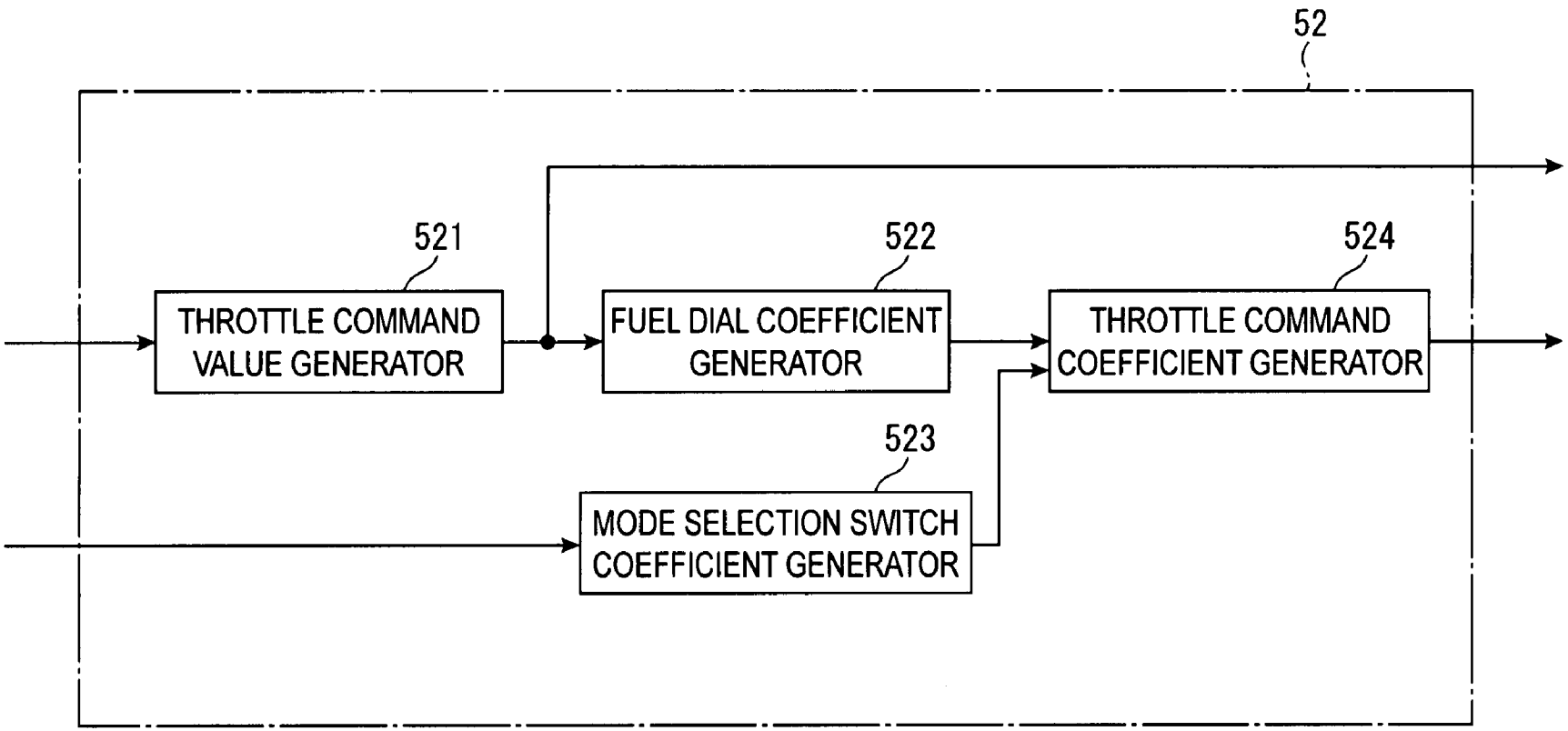
FIG. 3 is a block diagram for explaining a throttle command generating means of the rotation control device according to the first embodiment.

The throttle command generating means 52 generates the rotation speed coefficient according to setting conditions of the fuel dial 13 and the mode selection switch 14 and outputs the rotation speed coefficient to the speed coefficient generating means 55. In short, the throttle command generating means 52 generates the rotation speed coefficient by taking into account of engine speed, which is a changing factor of the rotation speed of the rotary body in the hydraulic excavator. For this purpose, the throttle command generating means 52 includes a throttle command value generator 521, a fuel dial coefficient generator 522, a mode selection switch coefficient generator 523 and a throttle command coefficient generator 524 as shown in FIG. 3.

The throttle command value generator 521 generates a throttle command value according to the setting condition of the fuel dial 13 (fuel supply setting means) to control the amount of fuel supply (injection) to the engine 12. The generated throttle command value is output to a governor motor, which is used in a position control of a rack in a fuel injection pump (not shown).

Figure 4:
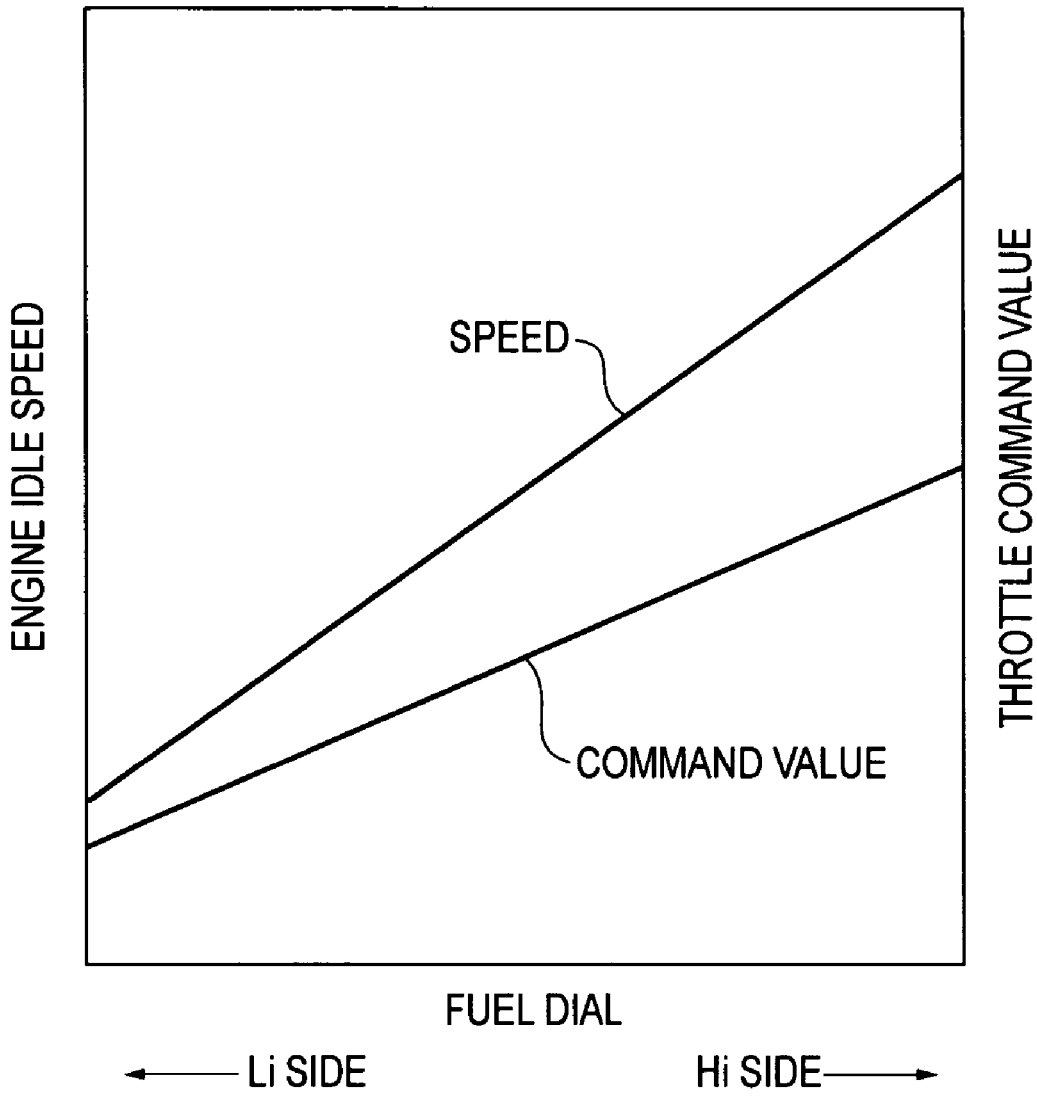
FIG. 4 is a graph showing a relation between setting of a fuel dial and engine idle speed according to the first embodiment.
Figure 5:
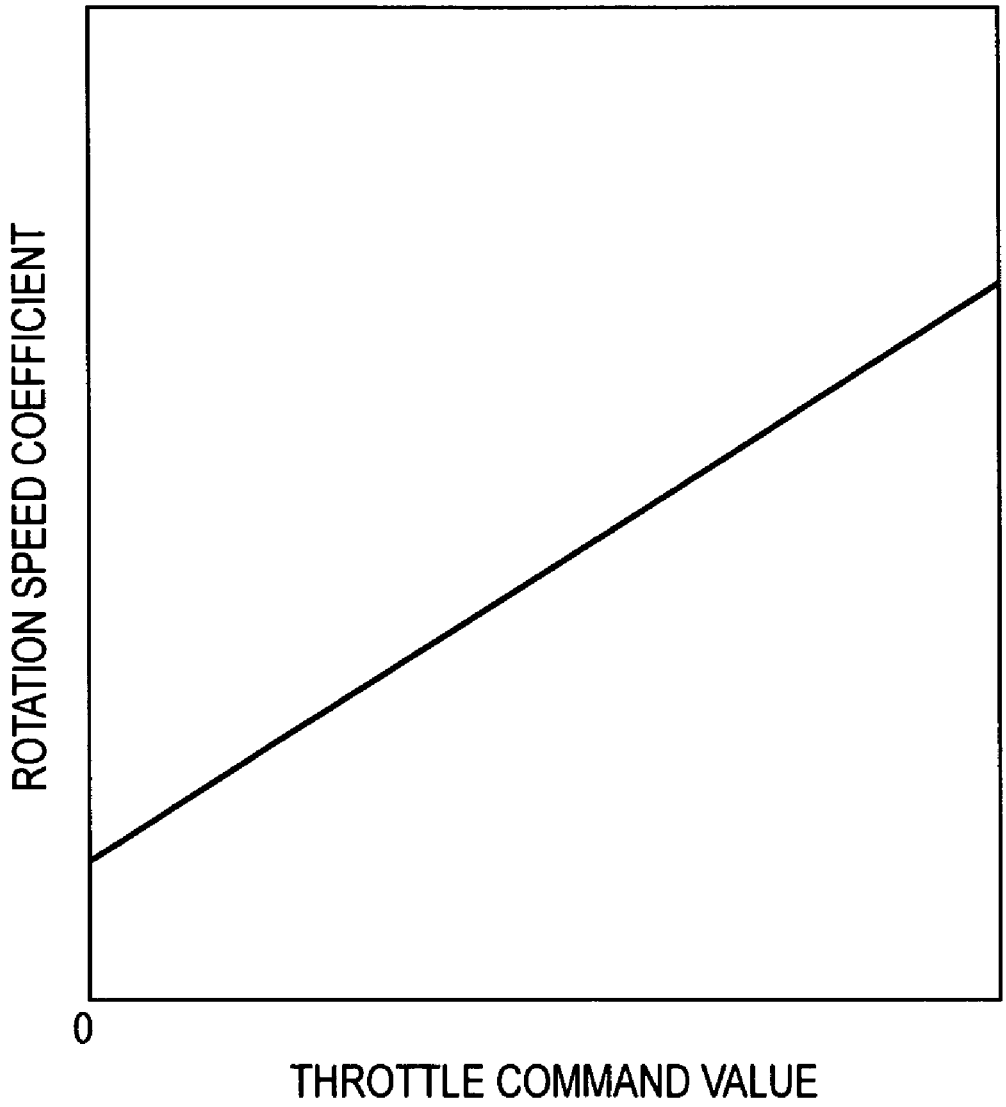
FIG. 5 is a graph showing a relation between a throttle command value and a rotation speed coefficient according to the first embodiment.

The fuel dial 13 is so arranged that its setting condition can be changed from Li (Low Idle) side to Hi (High Idle) side directly or stepwise. When the fuel dial 13 is turned to Hi side, the throttle command value generator 521 generates a large throttle command value, so that a relatively high idle speed is set for the engine 12 as shown in FIG. 4. In contrast, when the fuel dial 13 is turned to Li side, the throttle command value generator 521 generates a small throttle command value, so that a relatively low idle speed is set.

The fuel dial coefficient generator 522 generates a first rotation speed coefficient based on the throttle command value generated by the throttle command value generator 521. In the first embodiment, the first rotation speed coefficient is generated based on a relation between the throttle command value and the rotation speed coefficient shown in FIG. 5. Specifically, when the fuel dial 13 is turned to Hi side to increase the engine speed, the throttle command value generated by the throttle command value generator 521 increases, so that the first rotation speed coefficient increases. In contrast, when the fuel dial 13 is turned to Li side to decrease the engine speed, the throttle command value decreases, so that the first rotation speed coefficient decreases.

The mode selection switch coefficient generator 523 generates a second rotation speed coefficient based on a set mode of the mode selection switch 14 and outputs the second rotation speed coefficient to the throttle command coefficient generator 524. In the first embodiment, a value of the rotation speed coefficient for each set mode is preset, and the mode selection switch coefficient generator 523 selects a rotation speed coefficient in accordance with the set mode.

Figure 6:
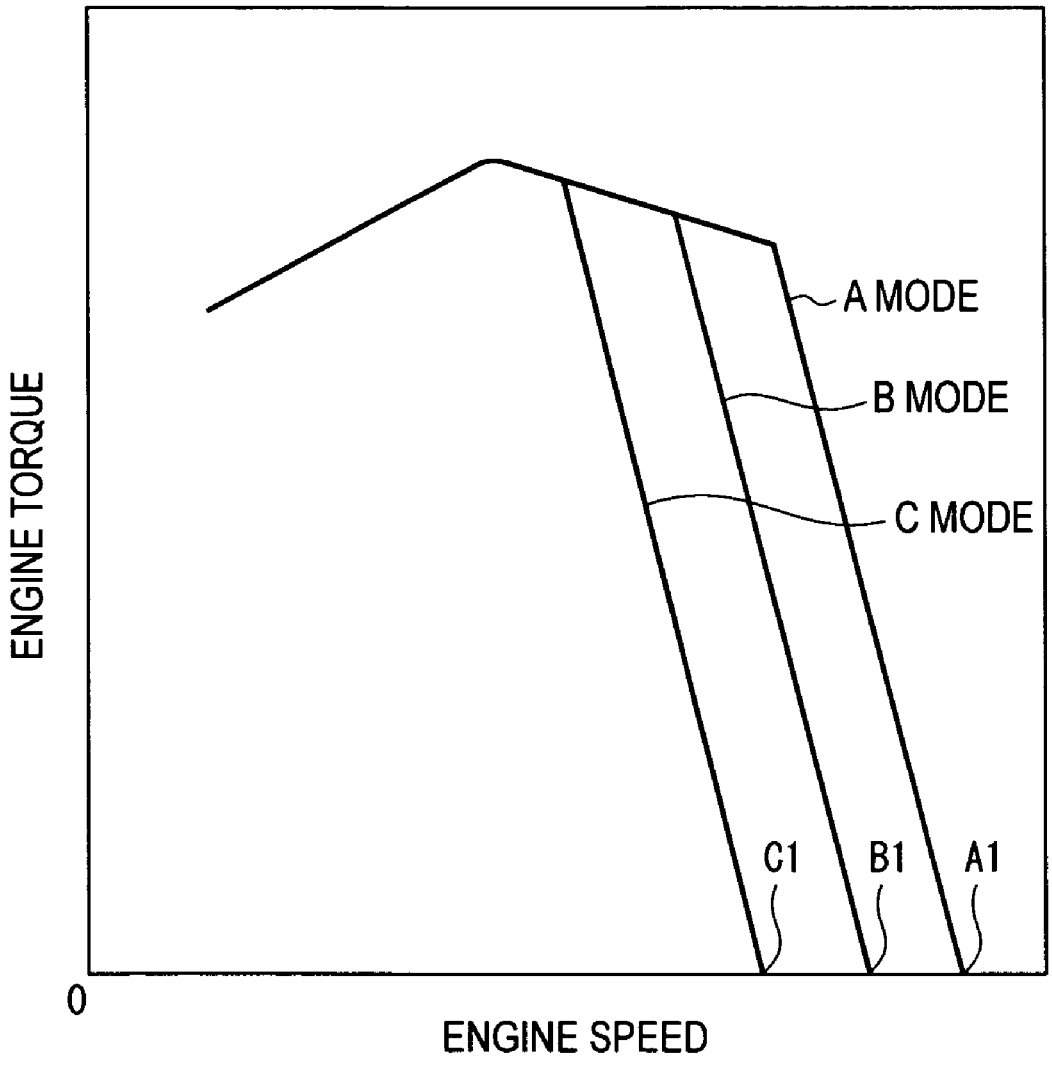
FIG. 6 is a graph showing a relation between engine speed and engine torque according to the first embodiment.

The mode selection switch 14 is a switch for selecting a work mode. Specifically, the mode selection switch 14 can select a work mode from A mode for performing a work at a high engine speed, B mode and C mode sequentially corresponding to works at lower engine speed. Specifically, as shown in FIG. 6, when the mode selection switch 14 selects A mode, the idle speed of the engine 12 is held at a high speed side of A1. Likewise, when the mode selection switch 14 selects B or C mode, the engine 12 is driven at an idle speed of B1 or C1.

The throttle command coefficient generator 524 generates a third rotation speed coefficient using the first rotation speed coefficient generated by the fuel dial coefficient generator 522 and the second rotation speed coefficient generated by the mode selection switch coefficient generator 523, and outputs the third rotation speed coefficient to the speed coefficient generating means 55. Specifically, the throttle command coefficient generator 524 multiplies the first rotation speed coefficient and the second rotation speed coefficient to generate the third rotation speed coefficient. Accordingly, the third rotation speed coefficient is a value that reflects the settings of the fuel dial 13 and the mode selection switch 14.

Referring back to FIG. 2, the work machine lever command generating means 53 generates a fourth rotation speed based on a tilt amount of the work machine lever 16 and outputs the fourth rotation speed coefficient to the speed coefficient generating means 55. Specifically, the fourth rotation speed coefficient is generated based on a relation between the operation amount of the work machine lever 16 and the rotation speed coefficient shown in FIG. 7. Accordingly, when the operation amount of the work machine lever 16 is large, a small rotation speed coefficient is generated. In contrast, when the operation amount is small, a large control speed coefficient is generated.

The gain selection switch command generating means 54 generates a fifth rotation speed coefficient based on a setting of the gain selection switch 15 and outputs the fifth rotation speed coefficient to the speed coefficient generating means 55. Here, the gain selection switch 15 is a switch for setting the rotation control speed coefficient to a desired value independently of the throttle command value. In the first embodiment, the gain selection switch 15 can select high speed rotation, middle speed rotation, low speed rotation, ultralow speed rotation and the like. Accordingly, when the gain selection switch 15 selects the high speed rotation, the gain selection switch command generating means 54 obtains a large rotation speed coefficient, while when the gain selection switch 15 selects the low speed rotation, the gain selection switch command generating means 54 obtains a small rotation speed coefficient.

Figure 8:
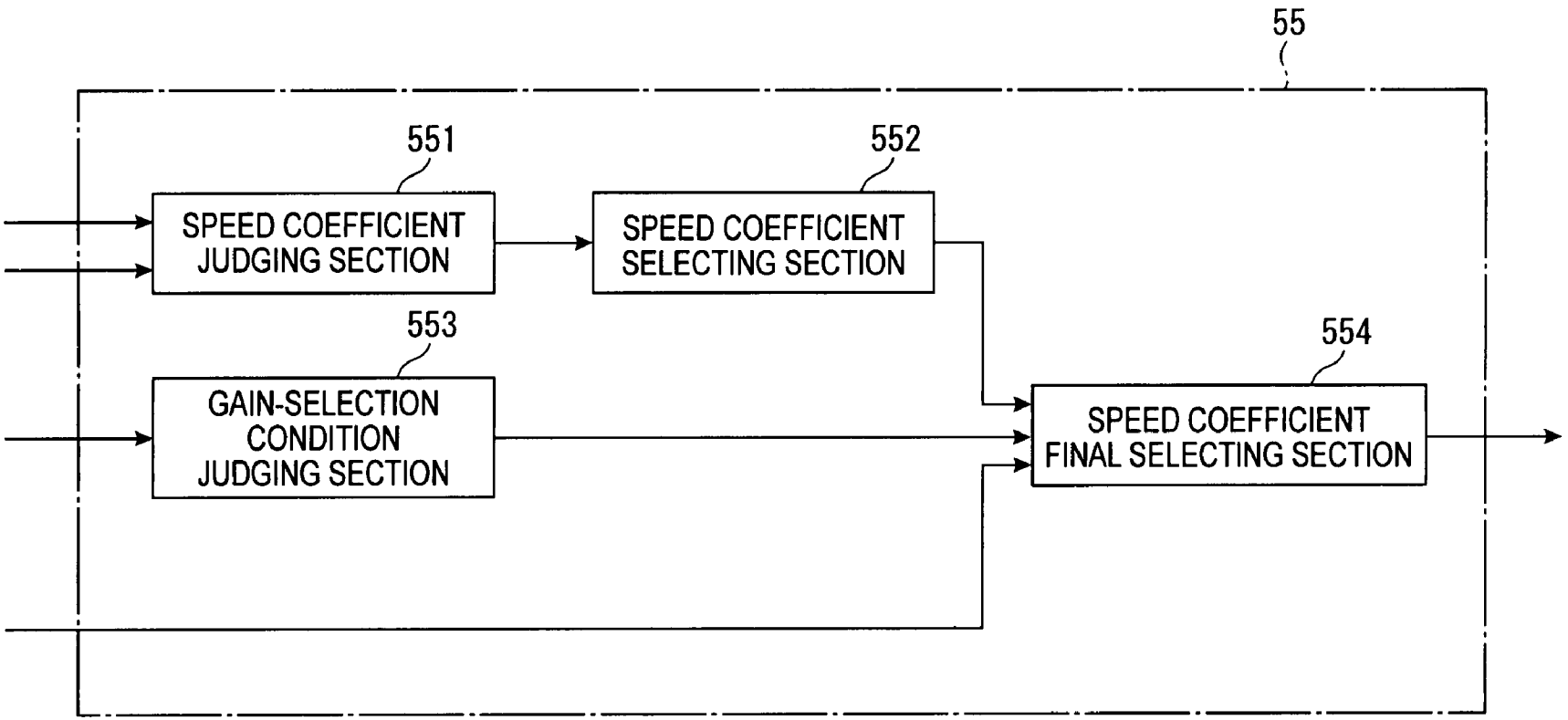
FIG. 8 is a block diagram for explaining a speed coefficient generating means of the rotation control device according to the first embodiment.

The speed coefficient generating means 55 generates a final rotation speed coefficient based on the third rotation speed coefficient generated by the throttle command coefficient generator, the fourth rotation speed coefficient generated by the work machine lever command generating means 53 and the setting condition of the gain selection switch 15. For this purpose, the speed coefficient generating means 55 includes, as shown in FIG. 8, a speed coefficient judging section 551, a speed coefficient selecting section 552, a gain-selection condition judging section 553 and a speed coefficient final selecting section 554.

The speed coefficient judging section 551 judges which one of the third rotation speed coefficient generated by the throttle command coefficient generator 524 of the throttle command generating means 52 and the fourth rotation speed coefficient generated by the work machine lever command generating means 53 is smaller.

The speed coefficient selecting section 552 selects a rotation speed coefficient with a smaller value from the third rotation speed coefficient and the fourth rotation speed coefficient based on the judgment result of the speed coefficient judging section 551.

Specifically, when it is judged that the third rotation speed coefficient generated by the throttle command coefficient generator 524 is smaller than the fourth rotation speed coefficient generated by the work machine lever command generating means 53, the speed coefficient selecting section 552 selects the third rotation speed coefficient. Accordingly, as will be described later, when the speed coefficient final selecting section 554 selects the value selected by the speed coefficient selecting section 552 as the final rotation speed coefficient, the rotation speed of the rotary body 4 according to the operation amount of the rotation lever will change in accordance with the feature of the third rotation speed coefficient. In short, the rotation speed of the rotary body 4 according to the operation amount of the rotation lever changes in accordance with the settings of the fuel dial 13 and the mode selection switch 14 as shown in FIG. 9.

Figure 9:
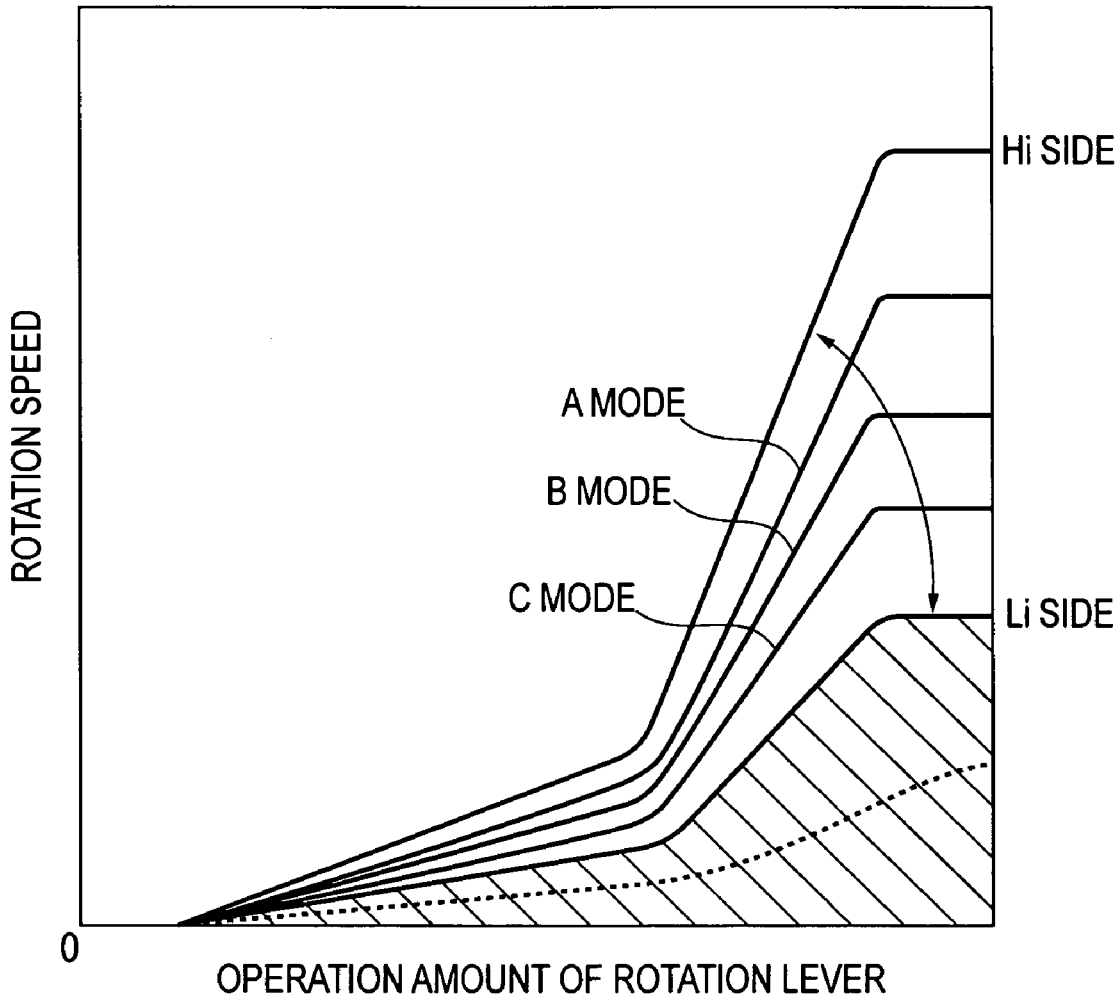
FIG. 9 is a graph showing a relation between the operation amount of a rotation lever and rotation speed according to the first embodiment.

In FIG. 9, "Hi side" refers to a rotation speed of the time when the fuel dial 13 is turned maximally to Hi side, while "Li side" refers to a rotation speed of the time when the fuel dial 13 is turned maximally to Li side. FIG. 9 shows a relation between the operation amount of the rotation lever and the rotation speed for each time when the mode selection switch 14 selects A to C modes. As shown in FIG. 9, in a state where the operation amount of the rotation lever is the same, the rotation speed of the rotary body 4 becomes highest when the fuel dial 13 is turned maximally to Hi side, while the rotation speed becomes lowest when the fuel dial 13 is turned maximally to Li side. In addition, a characteristic of the rotation speed for each mode selected by the mode selection switch 14 is set so as to be contained in this range, so that the rotation speed is higher in A mode with higher engine speed than in B mode and the rotation speed is higher in B mode than in C mode.

Figure 7:
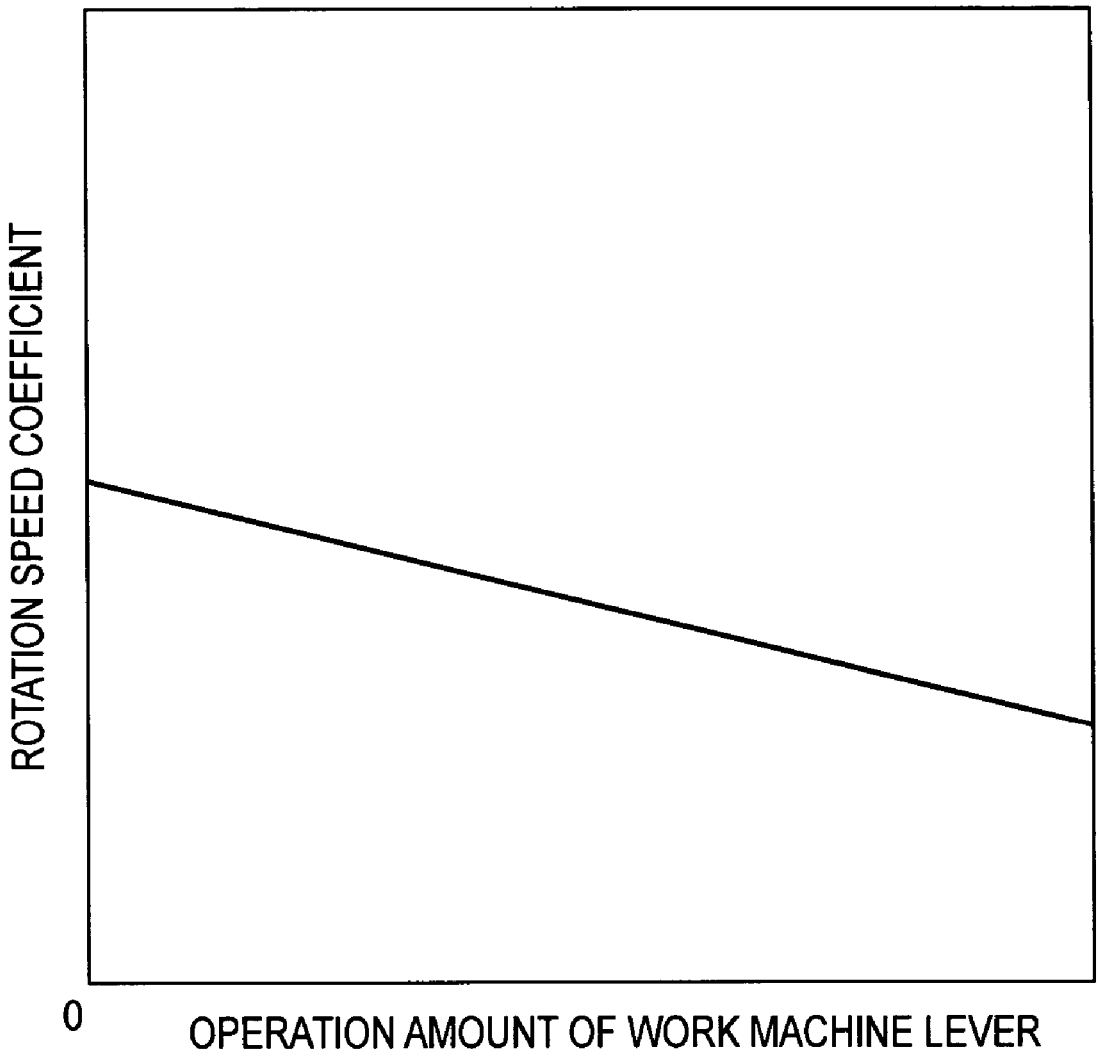
FIG. 7 is a graph showing a relation between an operation amount of a work machine lever and the rotation speed coefficient according to the first embodiment.

On the other hand, when it is judged that the fourth rotation speed coefficient generated by the work machine lever command generating means 53 is smaller than the third rotation speed coefficient generated by the throttle command coefficient generator 524, the speed coefficient selecting section 552 selects the fourth rotation speed coefficient. Accordingly, as will be described later, when the speed coefficient final selecting section 554 selects the value selected by the speed coefficient selecting section 552 as the final rotation speed coefficient, this rotation speed coefficient will be a value determined by the operation amount of the work machine lever 16 independently of the operating amount of the rotation lever 10 as shown in FIG. 7.

Referring back to FIG. 8, the gain-selection condition judging section 553 judges whether any setting is selected by the gain selection switch 15.

The speed coefficient final selecting section 554 selects one value of a fifth rotation speed coefficient generated by the gain selection switch command generating means 54 and the rotation speed coefficient selected by the speed coefficient selecting section 552 in accordance with the judgment result of the gain-selection condition judging section 553 and outputs the selected value as the final rotation speed coefficient. In short, when no setting is selected by the gain selection switch 15, the speed coefficient final selecting section 554 selects the rotation speed coefficient selected by the speed coefficient selecting section 552 as described above.

On the other hand, when it is judged that some setting is selected by the gain selection switch 15, the speed coefficient final selecting section 554 gives higher priority to the setting of the gain selection switch 15 in selecting the rotation speed coefficient, and thus the speed coefficient final selecting section 554 selects the rotation speed coefficient generated by the gain selection switch command generating means 54 and outputs it as a value of the final rotation speed coefficient. In short, the rotation speed can be adjusted to the high speed rotation, the middle speed rotation, the low speed rotation and the ultralow speed rotation without changing the speed of the engine 12.

Figure 10:
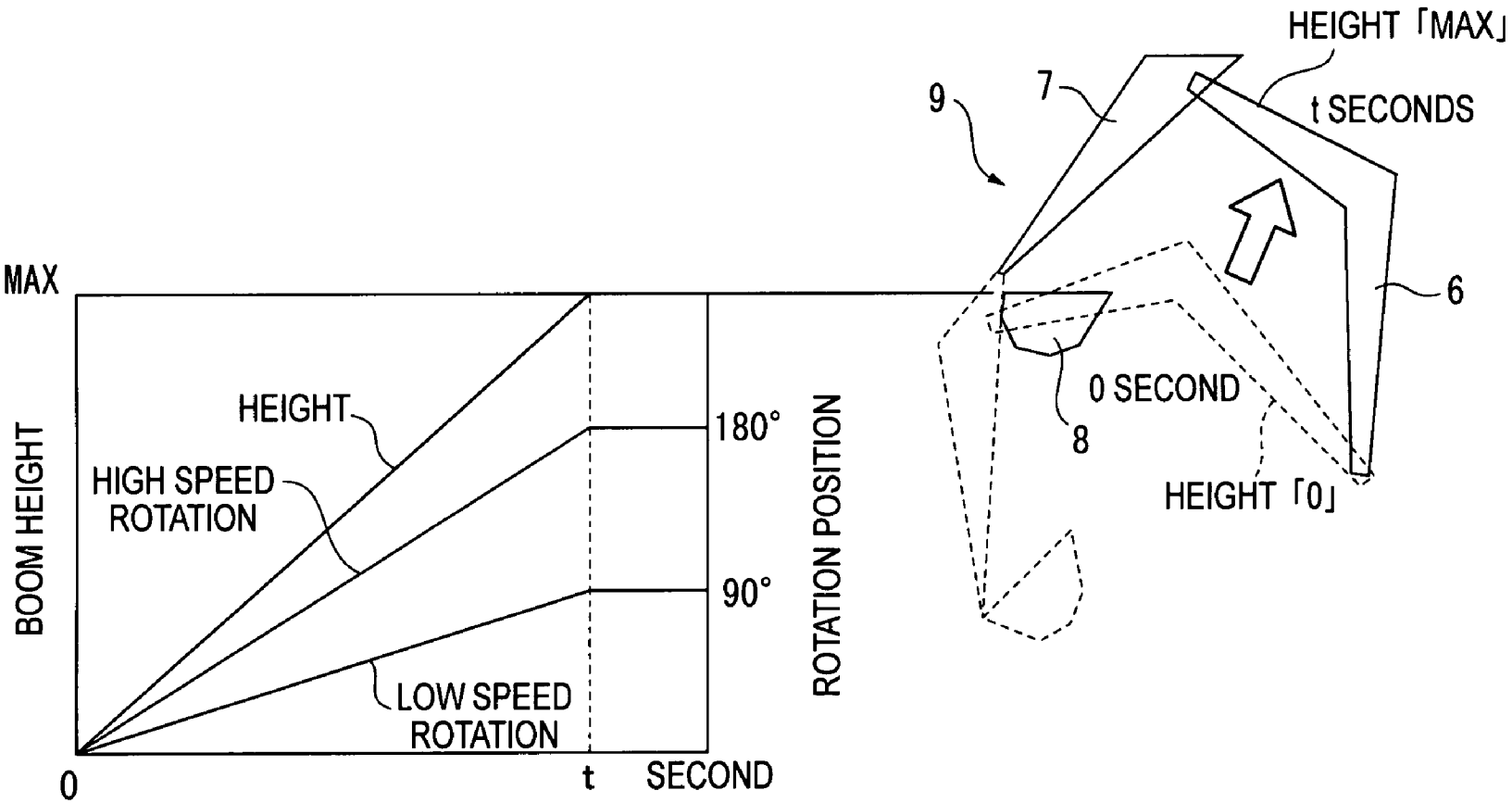
FIG. 10 is a graph showing relations between a time required for rotation, a boom height and a rotation position according to the first embodiment.
Figure 11:
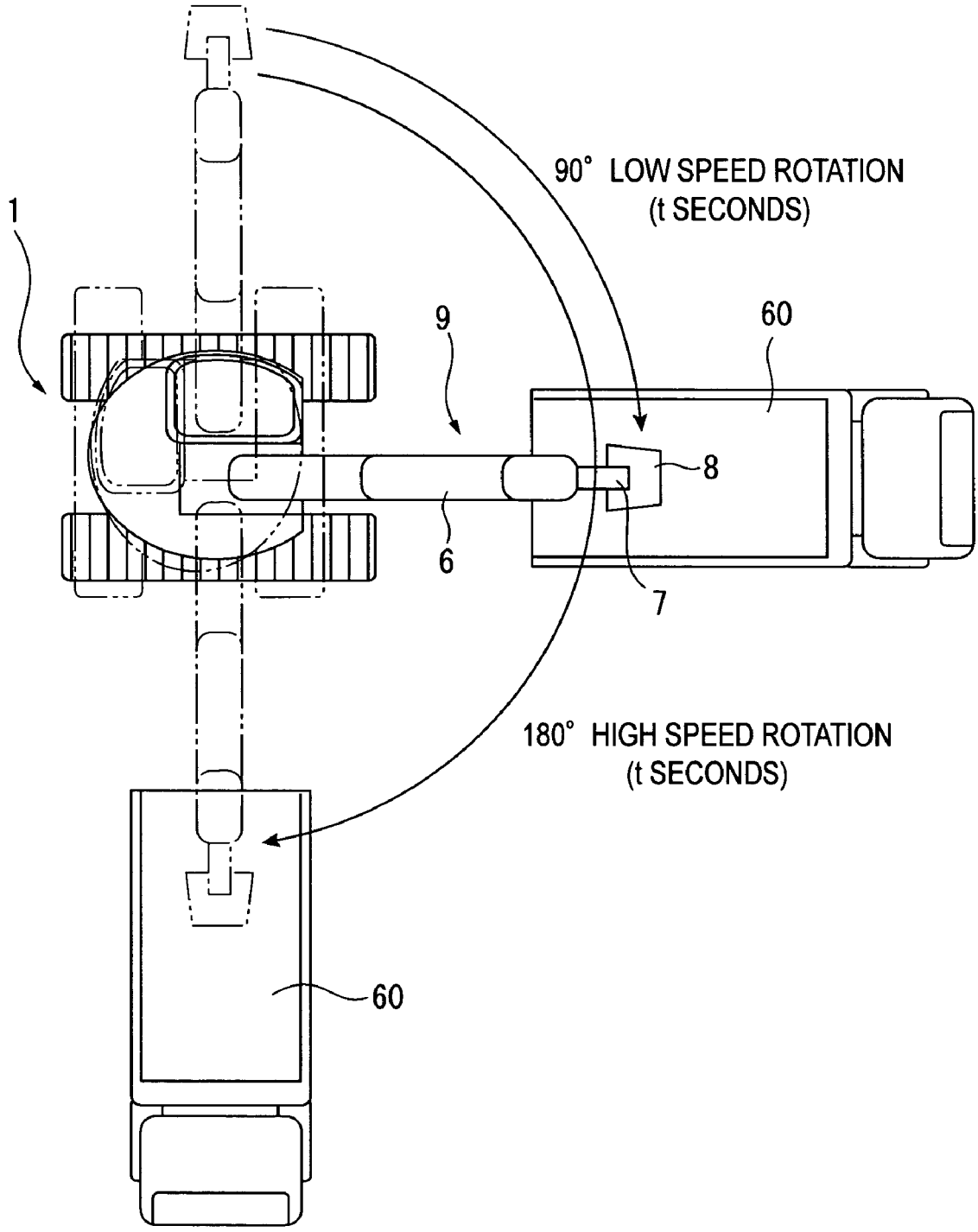
FIG. 11 is an illustration for explaining works of which rotation amounts are different according to the first embodiment.

Note that the selection by the gain selection switch 15 is performed when for instance, the works as shown in FIG. 10 and 11 are performed. In the drawings, an example in which the rotation speed is switched between the high speed rotation and the low speed rotation is shown. When excavation is performed using the electric rotary excavator 1, a position for performing the excavation and a position of a haulage vehicle 60 for carrying the excavated material are typically displaced from each other by 90° or 180° as a rotation angle of the rotary body 4. However, loading height to the haulage vehicle 60 (boom height) is constant. In addition, in view of workability, the work machine 9 (boom 6) should be positioned at the loading height when the rotary body 4 is rotated by 90° or 180° in order to realize unwasted motion. Accordingly, when the haulage vehicle 60 is at a position rotated by 90°, the gain selection switch 15 selects the low speed rotation, while when the haulage vehicle 60 is at a position rotated by 180°, the gain selection switch 15 selects the high speed rotation, so that the rotation of the rotary body 4 is completed at the time when the work machine 9 is lifted up to the predetermined loading height (after t seconds) to realize the unwasted motion.

When the gain selection switch 15 selects the ultralow speed rotation, a very small value is generated as the rotation speed coefficient, thereby greatly decreasing the rotation speed. For example, in the ultralow rotation speed, the rotary body 4 can be rotated in an ultralow rotation speed range shown by the hatched portion in FIG. 9. Specifically, such control realizes the rotation speed as shown in the dotted curve line. With the arrangement, the rotation speed will not increase so much even when the rotation lever 10 is tilted to a large extent, which is efficient in an ultralow speed operation for highly precisely positioning the work machine 9 in a rotation direction.

As described above, the speed coefficient generating means 55 of the control device 50 generates the rotation speed coefficient comprehensively based on the various input signals. Accordingly, the rotation speed coefficient that is precisely adjusted according to each setting is generated, thus generating the target speed command value that will consequently give the operator no confusion with an operation feeling that is substantially similar to conventional hydraulic excavators.

Referring back to FIG. 2, the target speed command generating means 56 generates the target speed command value based on the reference target speed generated by the speed command generating means 51 and the rotation speed coefficient generated by the speed coefficient generating means 55. Specifically, the target speed command generating means 56 generates the target speed command value through multiplication of the reference target value by the rotation speed coefficient.

Figure 12:
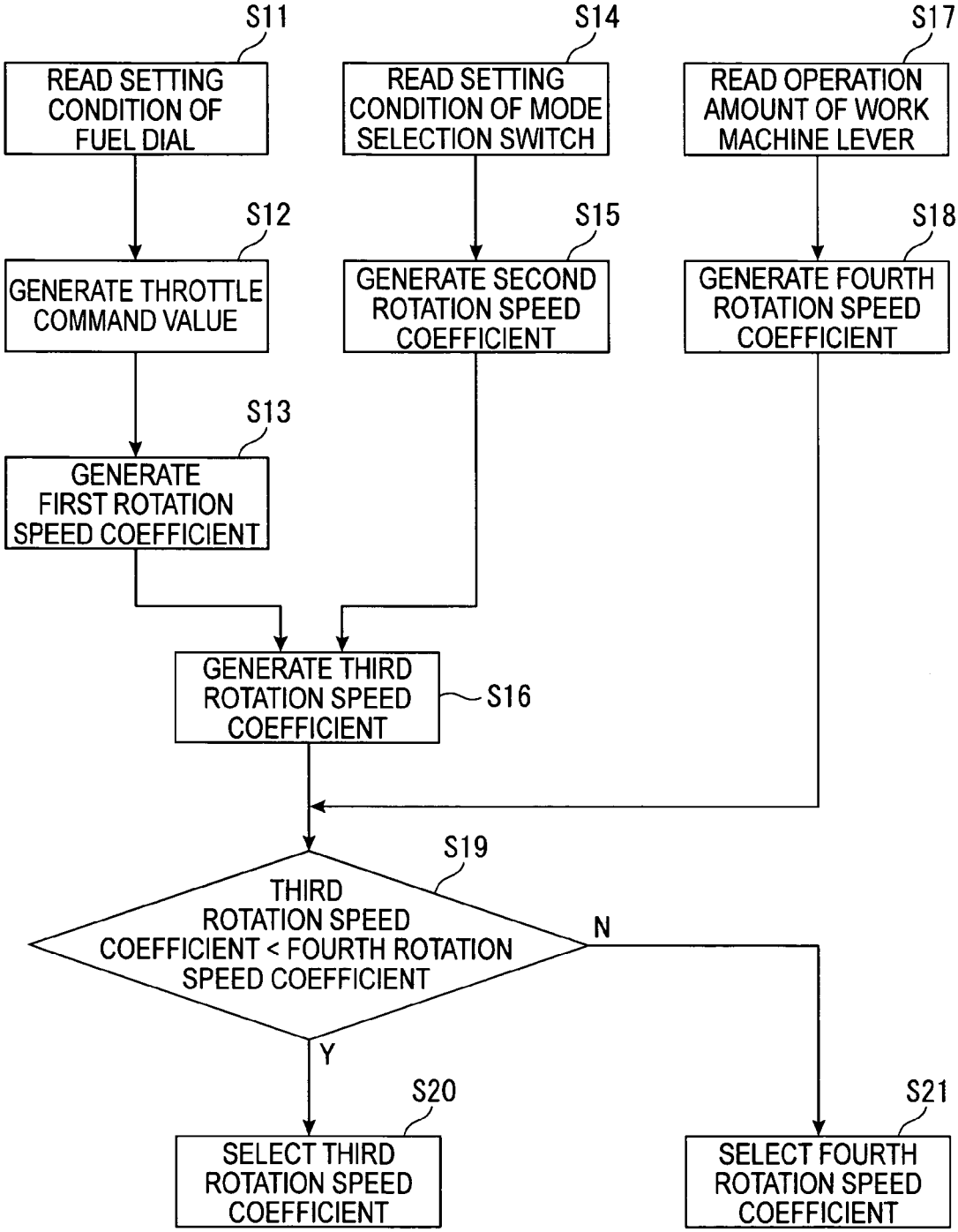
FIG. 12 is a flowchart for explaining how the rotation speed coefficient is generated by the rotation control device according to the first embodiment.

[1-3] Flow for Generating Rotation Speed Coefficient by Speed Coefficient Generating Means Now, a flow for generating the rotation speed coefficient by the speed coefficient generating means 55 especially in a case where no setting is selected by the gain selection switch 15 as a typical flow of the first embodiment will be described with reference to FIG. 12.

First, the throttle command value generator 521 of the throttle command generating means 52 reads the setting condition of the fuel dial 13 (Step 11, hereinafter and in the drawings, "Step" will be abbreviated as "S") and generates the throttle command value according to the setting condition (S12).

The fuel dial coefficient generator 522 generates the first rotation speed coefficient based on the throttle command value generated by the throttle command value generator 521 (S13).

The mode selection switch coefficient generator 523 reads the setting condition of the mode selection switch 14 (S14) and generates the second rotation speed coefficient according to the setting condition (S15).

Then, the throttle command coefficient generator 524 generates the third rotation speed coefficient through multiplication of the first rotation speed coefficient generated by the fuel dial coefficient generator 522 by the second rotation speed coefficient generated by the mode selection switch coefficient generator 523.

Meanwhile, the work machine lever command generating means 53 reads the operation amount of the work machine lever 16 (S17), and generates the fourth rotation speed coefficient based on the read value (S18).

The speed coefficient judging section 551 of the speed coefficient generating means 55 judges whether or not the third rotation speed coefficient generated by the throttle command coefficient generator 524 is smaller than the fourth rotation speed coefficient generated by the work machine lever command generating means 53 (SI9).

Here, when it is judged that the third rotation speed coefficient is smaller than the fourth rotation speed coefficient, the speed coefficient selecting section 552 selects the third rotation speed coefficient (S20). On the other hand, when it is judged that the fourth rotation speed coefficient is smaller than the third rotation speed coefficient, the speed coefficient selecting section 552 selects the fourth rotation speed coefficient (S21).

[1-4] Advantages of Embodiment

According to the first embodiment, the following advantages can be obtained.

Specifically, the control device 50 mounted in the electric rotary excavator 1 generates the rotation speed coefficient in accordance with the setting condition of the fuel dial 13 and the selection condition of the mode selection switch 14 and changes the rotation speed of the rotary body 4 based on the rotation speed coefficient. With the arrangement, when the engine speed becomes low by operating the fuel dial 13 and the mode selection switch 14, the rotation speed of the rotary body 4 can be decreased accordingly, while when the engine speed becomes high, the rotation speed can be increased accordingly.

Further, since the rotation speed coefficient can be changed in accordance with the selection condition of the gain selection switch 15 and the operation amount of the work machine lever 16, the rotation speed of the rotary body 4 can be arbitrarily changed by operating the gain selection switch 15 when the rotation speed is desired to be deliberately changed independently of the speed of the engine 12. In addition, when the work machine is operated during the rotation, the rotation speed can be decreased.

Therefore, the electric rotary excavator 1 can realize the operation feeling substantially similar to a conventional arrangement for hydraulically rotating the rotary body 4, so that the operator is not confused even when the operator shifts excavators from the conventional hydraulic excavator to the electric rotary excavator 1.

Second Embodiment

Figure 13:
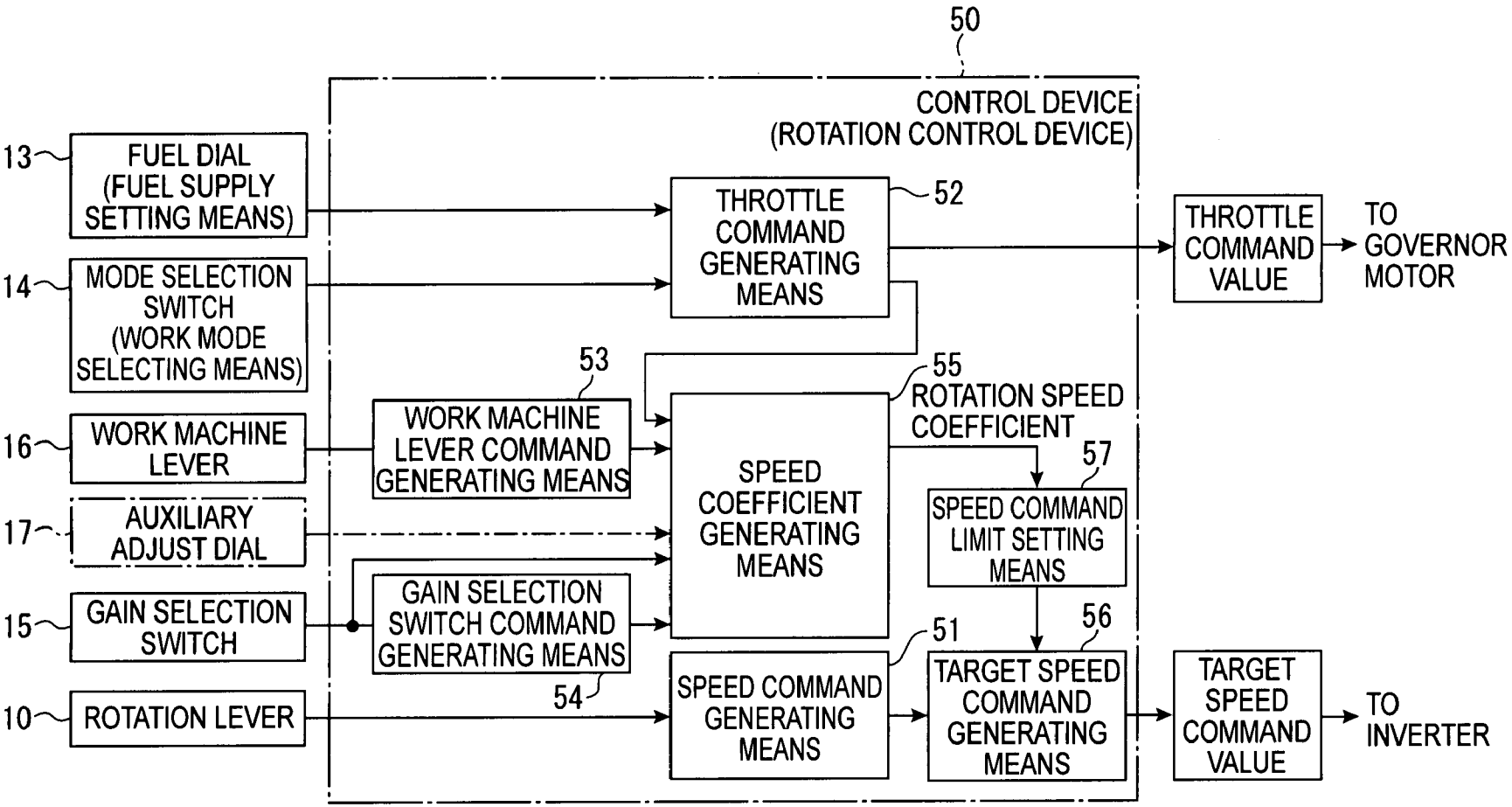
FIG. 13 is a block diagram for explaining a rotation control device mounted in a construction machine according to a second embodiment of the present invention.

FIG. 13 shows a second embodiment of the present invention.

In the second embodiment, a target speed command value of the rotary body 4 is generated by setting the upper limit of the reference target speed, which is different from the first embodiment in which the target speed command value is generated through multiplication of the reference target speed by the rotation speed coefficient. Accordingly, the control device 50 includes a speed command limit setting means 57. In addition, processing performed by the target speed command generating means 56 is different from that in the first embodiment.

The speed command limit setting means 57 converts the rotation speed coefficient generated by the speed coefficient generating means 55 to a speed command limit value for the reference target speed. Here, the speed command limit setting means 57 generates the speed command limit value through multiplication of a preset maximum value of the target speed command value by the rotation speed coefficient.

The target speed command generating means 56 sets the upper limit of the reference target value generated by the speed command generating means 51 to the speed command limit value generated by the speed command limit setting means 57, thereby generating the target speed command value.

Other arrangements and the flow are the same as those in the first embodiment, the description of which will be omitted.

According to the second embodiment, the advantages similar to the first embodiment can be obtained without degrading speed responsivity in a low speed range.

Incidentally, the present invention is not limited to the embodiments described above, but includes other components or the like that can achieve the object of the present invention, and also include modifications as shown below.

For example, the gain selection switch 15 is provided so that the rotation speed coefficient is generated stepwise in accordance with the selection of the high speed rotation, the middle speed rotation, the low speed rotation and the ultralow speed rotation, independently of the engine speed in the embodiments above. However, an auxiliary adjust dial 17 shown by the chain double-dashed line in FIG. 2 may be provided, so that the rotation speed coefficient is continuously changed to continuously change the rotation speed independently of the engine speed.

Further, both of the gain selection switch 15 and the auxiliary adjust dial 17 may be provided, so that the rotation speed coefficient is changed gradually and continuously in each speed range selected by the gain selection switch 15.

Although the final rotation speed coefficient is generated through selection or multiplication of a plurality of rotation speed coefficients in the embodiments above, the arrangement is not limited thereto. The rotation speed coefficient may be generated from an average value as long as the object of the present invention can be attained.

In addition, the rotation speed coefficient is generated comprehensively based on the various input signals in the embodiments above, a value may be selected base on a single type of signal out of the various input signals.

Although the final target speed command value is changed through multiplication of the reference target speed by the rotation speed coefficient in the first embodiment, the reference target speed itself may be selected from a plurality of set reference target speeds and the selected reference target speed may be used as the target speed command value.

Although the best arrangement and method for implementing the present invention has been disclosed above, the present invention is not limited thereto. In other words, while the present invention has been described with reference to the specific embodiments and the drawings thereof, various modifications may be made to the disclosed embodiments by those of ordinary skill in the art without departing from the spirit and scope of the invention.

INDUSTRIAL APPLICABILITY

The present invention is applicable to a control device that is used for rotating a rotary body by an electric motor. A machine in which such control device is mounted is not limited to a construction machine. In addition, in a case with the construction machine, such control device may be mounted not only in excavators but also in any construction machine as long as it includes the rotary body that is rotated by the electric motor.

The invention claimed is:

1. A rotation control device for an electric motor that drives a rotary body provided with a work machine of a construction machine, the electric motor driving the rotary body in accordance with an operation of a rotation lever, the rotation control device comprising:

a target speed command generating unit that generates a target speed command value of the electric motor in accordance with the operation of the rotation lever, wherein the target speed command generating unit changes the target speed command value in accordance with at least one of:

a setting condition of a fuel supply setting means for setting an engine speed of an engine that is used in conjunction with the electric motor;

an operation amount of a work machine lever for operating the work machine that is driven by the engine; and a selection condition of a work mode selecting means for selecting a work mode of a work performed using the work machine to set a fuel supply to the engine.

2. A rotation control method for an electric motor that drives a rotary body provided with a work machine of a construction machine, the electric motor driving the rotary body in accordance with an operation of a rotation lever, the rotation control method comprising:

generating a target speed command value of the electric motor in accordance with the operation of the rotation lever; and changing the target speed command value of the electric motor in accordance with at least one of:

a setting condition of a fuel supply setting means for setting an engine speed of an engine that is used in conjunction with the electric motor;

an operation amount of a work machine lever for operating the work machine that is driven by the engine; and a selection condition of a work mode selecting means for selecting a work mode of a work performed using the work machine to set a fuel supply to the engine.

3. A construction machine, comprising:

a rotary body provided with a work machine;

a rotation lever that is actuated to cause rotation of the rotary body;

an electric motor that drives the rotary body in accordance with operation of the rotation lever; and a rotation control device for controlling the electric motor, wherein the rotation control device changes a target speed command value of the electric motor in accordance with at least one of:

a setting condition of a fuel supply setting means for setting an engine speed of an engine that is used in conjunction with the electric motor;

an operation amount of a work machine lever for operating the work machine that is driven by the engine; and a selection condition of a work mode selecting means for selecting a work mode of a work performed using the work machine to set a fuel supply to the engine.

* * * * *